US006688426B1

(12) United States Patent
Mikros

(10) Patent No.: US 6,688,426 B1
(45) Date of Patent: Feb. 10, 2004

(54) WHEEL EXTENSION AND LIFT DEVICE FOR LADDERS

(76) Inventor: Harry Mikros, 78 Cypress Ave., Bethpage, NY (US) 11714

( * ) Notice: Subject to any disclaimer, the term of this patent is extended or adjusted under 35 U.S.C. 154(b) by 0 days.

(21) Appl. No.: 10/091,210

(22) Filed: Mar. 2, 2002

(51) Int. Cl.[7] ..... E04G 3/16

(52) U.S. Cl. ..... 182/17; 182/15; 182/107; 182/180; 248/238

(58) Field of Search ..... 182/15, 17, 107, 182/127, 180; 248/188.2, 238; 16/29, 48

(56) References Cited

U.S. PATENT DOCUMENTS

| | | | | | |
|---|---|---|---|---|---|
| 1,293,066 | A | | 2/1919 | Faulkner | |
| 2,503,626 | A | | 4/1950 | Mayberry | |
| 3,731,758 | A | * | 5/1973 | Hibma | 180/11 |
| 3,735,838 | A | * | 5/1973 | Greenleaf | 182/15 |
| 3,805,917 | A | * | 4/1974 | Luther | 182/200 |
| 3,997,024 | A | | 12/1976 | Fredericks et al. | |
| 4,053,025 | A | * | 10/1977 | Slusarenko | 180/2 R |
| 4,063,616 | A | | 12/1977 | Gutierrez | |
| 4,448,282 | A | | 5/1984 | Giezendanner | |
| 4,911,263 | A | | 3/1990 | Kuperman | |
| 5,464,071 | A | | 11/1995 | Rice et al. | |
| 5,584,357 | A | | 12/1996 | Gugel et al. | |
| 5,590,739 | A | | 1/1997 | High et al. | |
| 5,653,306 | A | | 8/1997 | Bendickson et al. | |
| 5,791,434 | A | * | 8/1998 | Swiderski | 182/17 |
| 6,026,931 | A | * | 2/2000 | Swiderski | 182/15 |
| 6,039,147 | A | | 3/2000 | Gillis et al. | |
| 6,179,087 | B1 | * | 1/2001 | Moffat | 182/15 |
| 6,305,496 | B1 | | 10/2001 | Bieszczad | |

* cited by examiner

*Primary Examiner*—Bruce A. Lev
(74) *Attorney, Agent, or Firm*—Michael I. Kroll

(57) ABSTRACT

A device for allowing a user to selectively extend and retract wheels at the feet of an A-frame stepladder thereby enabling the user to move the ladder from point "A" to point "B" without physically moving, lifting or dragging the ladder. The apparatus includes a gear assembly at the foot of each ladder siderail having an attached caster-style wheel. Each gear assembly is mechanically associated with a handgrip trigger mechanism located along the ladder siderail in a position convenient for the user to operate with each handgrip trigger mechanism controlling the two gear assemblies on the same side of the stepladder.

17 Claims, 12 Drawing Sheets

WHEEL EXTENSION AND LIFT DEVICE FOR LADDERS

BACKGROUND OF THE INVENTION

1. Field of the Invention

The present invention relates generally to ladders and, more specifically, to an extendable/retractable device for moving A-frame type stepladders. The device consists of four mechanisms providing means for extending/retracting wheel elements, one mechanism for each leg of the ladder and two control mechanism, each attached to a pair of leg mechanisms. When the handles of the control mechanisms are squeezed, the wheels are extracted until engaging the ground whereupon continued pressure applied to the control mechanism raises the ladder, enabling the user to move the ladder from point "A" to point "B" without physically lifting, closing or dragging the ladder.

The design consists of four retractable wheels positioned within a housing, one on each leg of the ladder and two grip handles attached to the wheels by a length of line. When the handles are squeezed the line contracts pulling the wheels along a gear face until they extend below the housing and raising the ladder enabling the user to move the ladder from point "A" to point "B" without lifting the ladder, closing the ladder or dragging the ladder.

A guide rack assembly is provided and includes; a rack, pulley, pinion, swivel wheel, pin, cable adjustment and rack guide. The rack gear is driven by the pinion gear which is a part of the pulley. When the handle is activated, the pulley and pinion gear move the rack gear and wheels in a downward motion. When the handle is released, a spiral spring located on the opposite side of the pulley releases the tension built on it when the cable was activated, causing the pinion gear to move the rack gear into its stored position.

2. Description of the Prior Art

There are other ladder devices designed for moving ladders. Typical of these is U.S. Pat. No. 1,293,066 issued to Faulkner on Feb. 4, 1919.

Another patent was issued to Mayberry on Apr. 11, 1950 as U.S. Pat. No. 2,503,626. A patent was issued to Fredericks et al. on Dec. 14, 1976 as U.S. Pat. No. 3,997,024. Yet another U.S. Pat. No. 4,063,616 was issued to Gutierrez on Dec. 20, 1977 and still yet another was issued on May 15, 1984 to Giezendanner as U.S. Pat. No. 4,448,282.

Another patent was issued to Kuperman on Mar. 27, 1990 as U.S. Pat. No. 4,911,263. Yet another U.S. Pat. No. 5,464,071 was issued to Rice et al. on Nov. 7, 1995. Another was issued to Gugel et al. on Dec. 17, 1996 as U.S. Pat. No. 5,584,357 and still yet another was issued on Jan. 7, 1997 to High et al. as U.S. Pat. No. 5,590,739.

Another patent was issued to Bendickson et al. on Aug. 5, 1997 as U.S. Pat. No. 5,653,306. Yet another U.S. Pat. No. 6,039,147 was issued to Gillis et al. on Mar. 21, 2000. Another was issued to Bieszczad on Oct. 23, 2001 as U.S. Pat. No. 6,305,496.

U.S. Pat. No. 1,293,066

Inventor: Albert N. Faulkner

Issued: Feb. 4, 1919

This invention relates to improvements in and relating to ladder feet, and has for its object to provide a device that attaches to a ladder as a non-slipping device.

U.S. Pat. No. 2,503,626

Inventor: Robert Mayberry

Issued: Apr. 11, 1950

The present invention relates to ladders and more particularly, to improve means for adjustably connecting ground engaging legs to the stiles of the ladder.

U.S. Pat. No. 4,063,616

Inventor: Ernest F. Gutierrez

Issued: Dec. 20, 1977

A safety ladder assembly having a plurality of steps and at least three support feet for supporting the ladder on a horizontal surface. A caster assembly having at least three casters for providing for rollingly transporting the ladder from one location to another. The casters are positively and conjointly moveable between a retracted storage position in which the support feet stably support the ladder on a horizontal surface and a second transporting position in which the casters stably support the ladder assembly on the horizontal surface with the support feet elevated thereabove so that the ladder assembly may be rollingly transported along the surface. A linkage interconnects the casters so that they may be raised and lowered via actuating and retracting pedals.

U.S. Pat. No. 4,448,282

Inventor: Ruedi Giezendanner

Issued: May 15, 1984

The ladder includes two separate ladder elements, which are pivotable and slidable relative to each other and can also be completely separated from each other. It can be used as a step-ladder and as a leaning type ladder. The ladder element is equipped with wheels, in order to simplify the transport of the collapsed ladder. In addition, an outwardly pivotable support plate is arranged between the wheels, so that the ladder element can serve as a hand truck, whereby the bent ends of the side beams serve as hand grips. The ladder has a simple construction and can be used in many ways in household use and in commercial operations.

U.S. Pat. No. 4,911,263

Inventor: Aryeh Kuperman

Issued: Mar. 27, 1990

Ambulatory ladder apparatus constructed as a stepladder frame supported on a set of four base wheels. A user-powered drive is mounted under the lowermost step of the ladder, and is mechanically connected with a pair of the base wheels. A drive arm extending from the drive is accessible to a user while aboard the stepladder. By pumping action of the drive arm, the user-powered drive causes rotation of the base wheels, moving the ladder forward. A steering mechanism provided on the drive arm allows the user to direct the motion of the ladder during the pumping action. Thus, without requiring the user to dismount, the ladder may be easily repositioned by operation of the drive, allowing greater work efficiency in many repair, remodeling, painting and construction projects, by eliminating the additional time normally required for dismounting and repositioning the ladder.

U.S. Pat. No. 4,911,263

Inventor: Aryeh Kuperman

Issued: Mar. 27, 1990

A portable collapsible scaffold ladder has a pair of upright caster-mounted end members joined together by a horizontal platform member. A pull-out ladder for scending to the platform is connectable at its upper end and sliable along its connected end member for movement between a nested position within that end member and a diagonally extending operative position. The platform member is joined to the two end members by T-shaped glide members pivoted to each of the four corners of the platform member. Each glide member has a glide portion slidable along one side of a connected end member and a pivot portion pivoted to an adjacent side portion of the platform member. Each glide member has a resilient leaf-type spring which carries two locking pins, one for interlocking with the platform and the other for interlocking with one of a series of pin-receiving openings in the upright. When the pins are engaged, the glide members rigidly interlock the platform member and two end members at right angles for use, or in parallel collapsed relationship for transport. When one pin of each pair of glide members is disengaged, the platform can be moved along the adjacent end member. When the opposite pin of each pair of glide members is disengaged, the platform and end members can be freely pivoted with respect to one another.

U.S. Pat. No. 5,464,071

Inventor: Crispin J. Rice et al.

Issued: Nov. 7, 1995

A new and improved ladder leveling device comprising a gear box having a plurality of gears coupled to an interior of the gear box on shafts. The shaft of a lowest gear extends outwardly of the gear box. A crank couples with the outwardly extending shaft of the lowest gear. The crank serves to rotate the lowest gear thereby collectively rotating the plurality of gears. A pin selectively couples with an uppermost gear and extends outwardly of the left wall. The pin serves to selectively engage or disengage the three gears. A plate is secured to a lower portion of the gear box. The plate serves to support the ladder's leg. Included in the device is a vertical rack having a plurality of teeth thereon. The vertical rack is secured within the gear box. The plurality of teeth engage the plurality of gears and are optionally raised or lowered by the rotation of the gears when the pin is disengaged. A foot pad is pivotally coupled with the vertical rack. The foot pad serves to lie flat on the ground and stabilize the device. An adjustable clamp is secured to the wall of the gear box upwardly of the plate. The clamp serves to secure the ladder's leg against the gear box.

U.S. Pat. No. 5,584,357

Inventor: Leslie H. Gugel et al.

Issued: U.S. Pat. No. 5,584,357

The instant invention is directed to increasing the safety of ladders and includes an accessory holder for the top of ladders forming a tray which expands in size allowing placement of working materials in the tray. The tray collapses into a size assimilating a conventional ladder top for compact storage. The tray can be raised to various heights and allows the operator to remove the tray in its entirety to carry items to the ladder providing for convenience and safety. An alternative embodiment provides for the use of solid portions in place of a tray allowing smaller ladders such as to be used as saw horses yet provide a means for forming a smaller tray for sacrament of miscellaneous working materials. The improved ladder employs handles that couple to each side limb of the ladder allowing an operator to grasp the handles while climbing. An electrical socket mounted in a limb provides for a prewired extension along the length of the limb providing an electrical connection near the top portion of the ladder. Biased wheels allow the ladder to be moved without lifting.

U.S. Pat. No. 5,590,739

Inventor: DeWayne High et al.

Issued: Jan. 7, 1997

A motorized utility extension ladder having a main and upper riser section extendable by a motor. The ladder further comprising a telescopic prop so that the ladder may be free standing, side wing legs for stabilizing the ladder, wheels for transporting the ladder, and a removable shelf.

U.S. Pat. No. 5,653,306

Inventor: Roy Bendickson et al.

Issued: Aug. 5, 1997

A ladder system comprising a ladder having side rails and a plurality of steps disposed between the side rails. The ladder system also is comprised of at least one corner brace for supporting a bottom step of the ladder. The corner brace is attached to a side rail of the ladder and the bottom step. Additionally, the ladder system is comprised of at least one caster assembly integrally attached to the corner brace for allowing the ladder to roll. Preferably, the caster assembly and corner brace are disposed on the ladder such that a predetermined weight placed on the ladder prevents the ladder from rolling. The corner brace is preferably comprised of a first portion, a second portion connected to the first portion and a third portion connected to the second portion. The first portion is attached to a bottom of the ladder. The second portion is attached to the caster assembly. Additionally, the third portion is attached to a rail of the ladder. A caster apparatus comprises a corner brace for supporting a bottom step of a ladder. The caster apparatus is also comprised of a caster assembly integrally attached to the corner brace for allowing the ladder to roll. A method for forming a ladder system. The method comprises the steps of attaching a caster assembly to a corner brace for a ladder such that the caster assembly is in biased sliding relationship with the corner brace. Then, there is the step of fixing the corner brace having the caster assembly to a bottom step of the ladder and to a side rail of the ladder such that the rail is maintained off of ground by the caster assembly when there is essentially no weight on the ladder. Preferably, after the fixing step, there is the step of rolling the ladder on the caster assembly to a desired location.

U.S. Pat. No. 6,039,147

Inventor: Donald Gillis et al.

Issued: Mar. 21, 2000

A safety ladder stand comprising a generally rectangular base having a front and rear and a center beam, a plurality of stair treads extending upward from the front of said base and means for supporting said stair treads secured to said base, front wheels mounted at the front of said base and beneath the top of said stair treads; center wheels mounted on said center beam of said base, and rear wheels mounted at the rear of said base, and a set of feet mounted on the front of said base; wherein said ladder stand has an activated position wherein said front and center wheel sets are in contact with the ground to enable said ladder stand to roll and said rear wheels and front support feet are not in contact with the ground, as well as a deactivated position wherein the front and center wheel sets are not in contact with the ground and said rear wheels and front support feet are in contact with the ground to prevent said ladder stand from being rolled; and means for moving said ladder stand from said deactivated position to said activated position.

U.S. Pat. No. 6,305,496

Inventor: Todd Bieszczad

Issued: Oct. 23, 2001

The ladder stand employs a pair of swivable caster wheels at the front and a pair at the rear which are used in cooperation with a pair of closely located non-swivable caster wheels, thereby providing a structure which has three modes of operation, one mode for climbing, a second mode which permits the stand to be pushed in a straight line with wide turns and a third mode of operation which permits the stand to be first pushed laterally and to provide sharp turns. A front wheel support is mounted on the front end and a retractable first pair of swivable caster wheels is mounted on the front support. A rear wheel support is mounted on the rear end, with a retractable second pair of swivable caster wheels mounted on the rear support. A third pair of non-swivable rigid caster wheels are mounted at the rear end.

While these ladder devices may be suitable for the purposes for which they were designed, they would not be as suitable for the purposes of the present invention, as hereinafter described. The device consists of four mechanisms for extending/retracting wheels, one on each leg of the ladder and control mechanisms attaching to the siderails of the stepladder. When the control mechanisms are squeezed, the wheel elements are extracted and touch the ground raising the ladder, enabling the user to move the ladder from point "A" to point "B" without lifting the ladder, closing the ladder or dragging the ladder.

SUMMARY OF THE PRESENT INVENTION

A primary object of the present invention is to provide an extendable retractable device for moving stepladders that consists of four retractable wheels with continued pressure lifting the ladder, one on each leg of the ladder and two grip handles attaching to the wheel or guide rack.

Another object of the present invention is to provide a grip and wheel device that when the handles are squeezed, the wheels are extracted and touch the ground, enabling the user to move the ladder from point "A" to point "B" without physically lifting, closing or dragging the ladder.

Another object of the present invention is to provide a guide rack assembly that includes; the rack, pulley, pinion, swivel wheel, pin, cable adjustment and rack guide.

Yet another object of the present invention is to provide a device that allows the user to move a ladder without the risk of injury to their back.

Additional objects of the present invention will appear as the description proceeds.

The present invention overcomes the shortcomings of the prior art by providing an extendable/retractable device for moving stepladders that consists of wheel extension/retraction mechanisms, one on each leg of the ladder and control mechanisms attaching to the siderails of the ladder. Also, a device that when the handles are squeezed, the wheels are extracted and touch the ground, enabling the user to move the ladder from point "A" to point "B" without physically lifting the ladder, closing the ladder or dragging the ladder.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
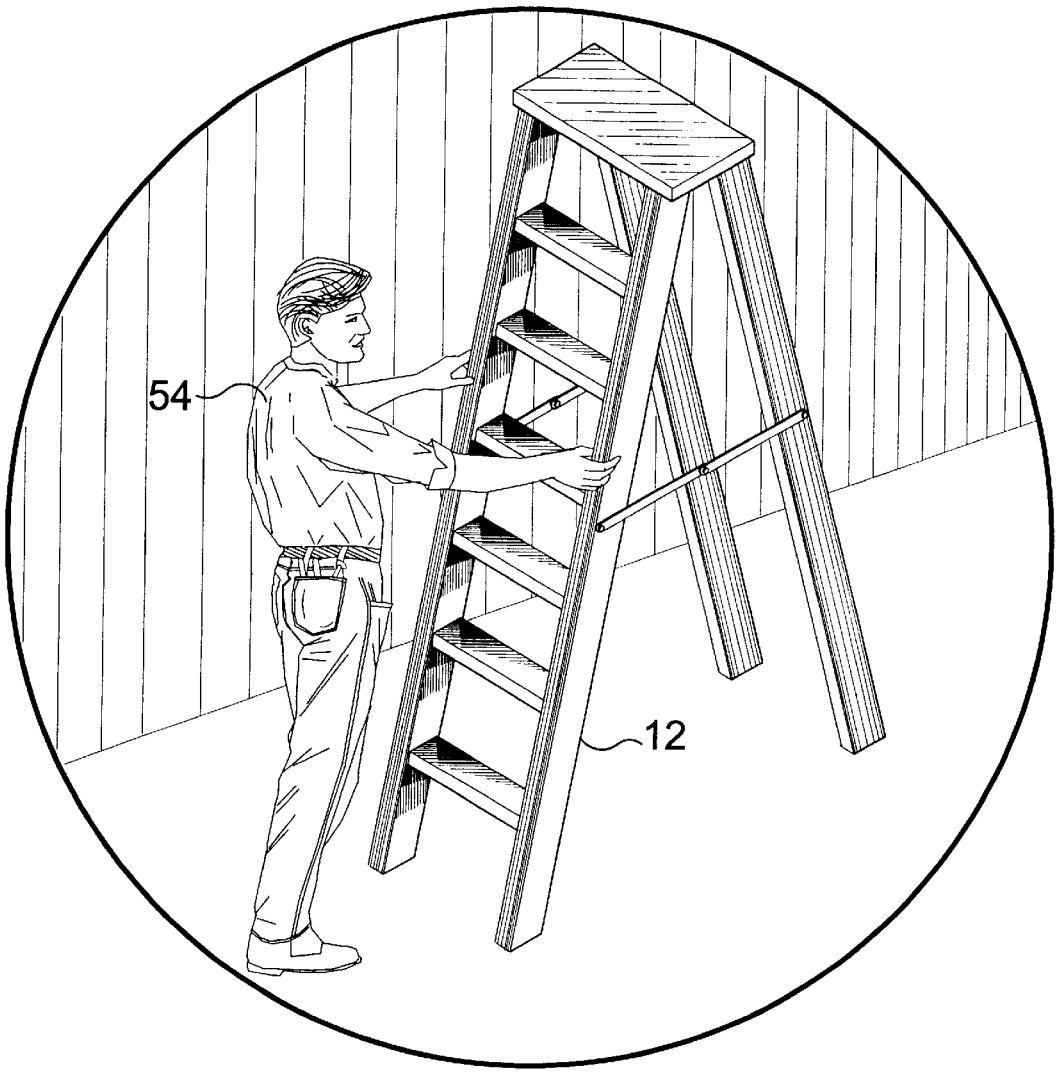
FIG. 1 is an illustrative view of prior art in use.

Turning now descriptively to the drawings, in which similar reference characters denote similar elements throughout the several views, the Figures illustrate the locator device of the present invention. With regard to the reference numerals used, the following numbering is used throughout the various drawing figures.

10 retractable wheel and lift device for ladders
12 ladder
14 siderail of 12
operator engagement means
20 hand grip trigger mechanism
22 cable
24 wheel member
26 wheel extension and retraction means
28 rack and pinion gear assembly
30 gear assembly housing
32 rack gear
36 bottom end of 32
38 rack guide
40 pinion assembly
41 pinion gear
42 pulley
44 first side of 42
46 second side of 42
48 post member of 42
spring retaining channel
spring retaining pin
54 operator
56 cable adjustment means
58 cable retaining recess
60 cable stop
62 first end of cable
64 second end of cable
66 flat spiral spring element
68 access cover of 30
70 axle pin
first end of 66
74 second end of 66
76 axle recess

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art. Conventional ladders 12 tend to be difficult and cumbersome to move about a work area. Lifting a ladder 12 from point "A" to point "B" tends to be a time consuming project and a back breaking effort, also, every time a user 54 must move a ladder 12 about a work area, the arms are extended forward while in movement, leaving a good chance for a back or shoulder injury to occur.

Figure 2:
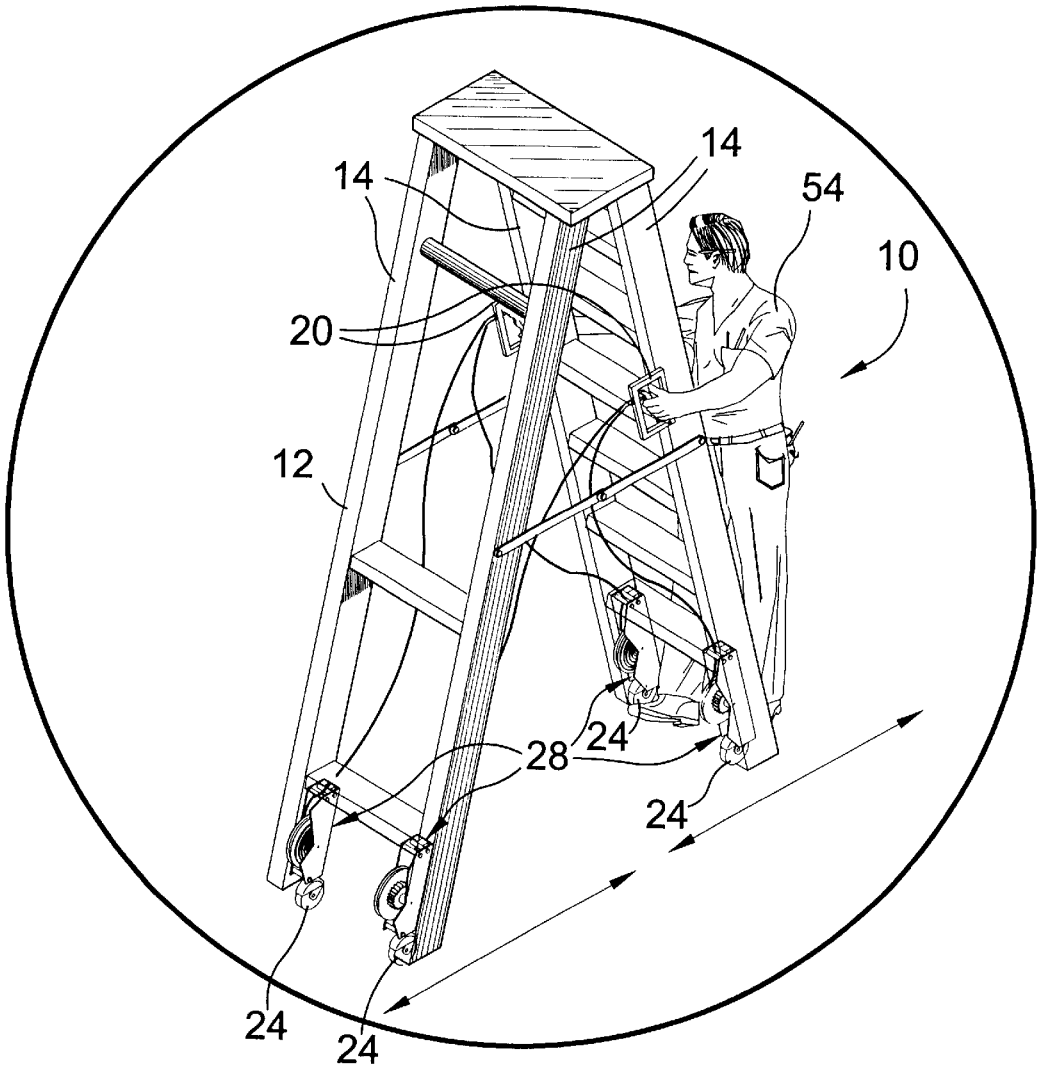
FIG. 2 is an illustrative view of the present invention in use.

FIG. 2 is an illustrative view of the present invention 10 in use. The present invention 10 is designed for A-frame type ladders but may also be adapted for use with extension ladders or other appropriate applications. The design consists of four retractable pivoting wheel members 24, one on each siderail 14 of the ladder 12 and two hand grip trigger mechanisms 20 attaching to the wheel 24 or guide rack. When the hand grip trigger mechanisms 20 are squeezed, the wheel members 24 are extracted and touch the ground and continued applied pressure raises the ladder thus enabling the user 54 to move the ladder 12 from point "A" to point "B" without physically lifting, closing or dragging the ladder 12.

Figure 3:
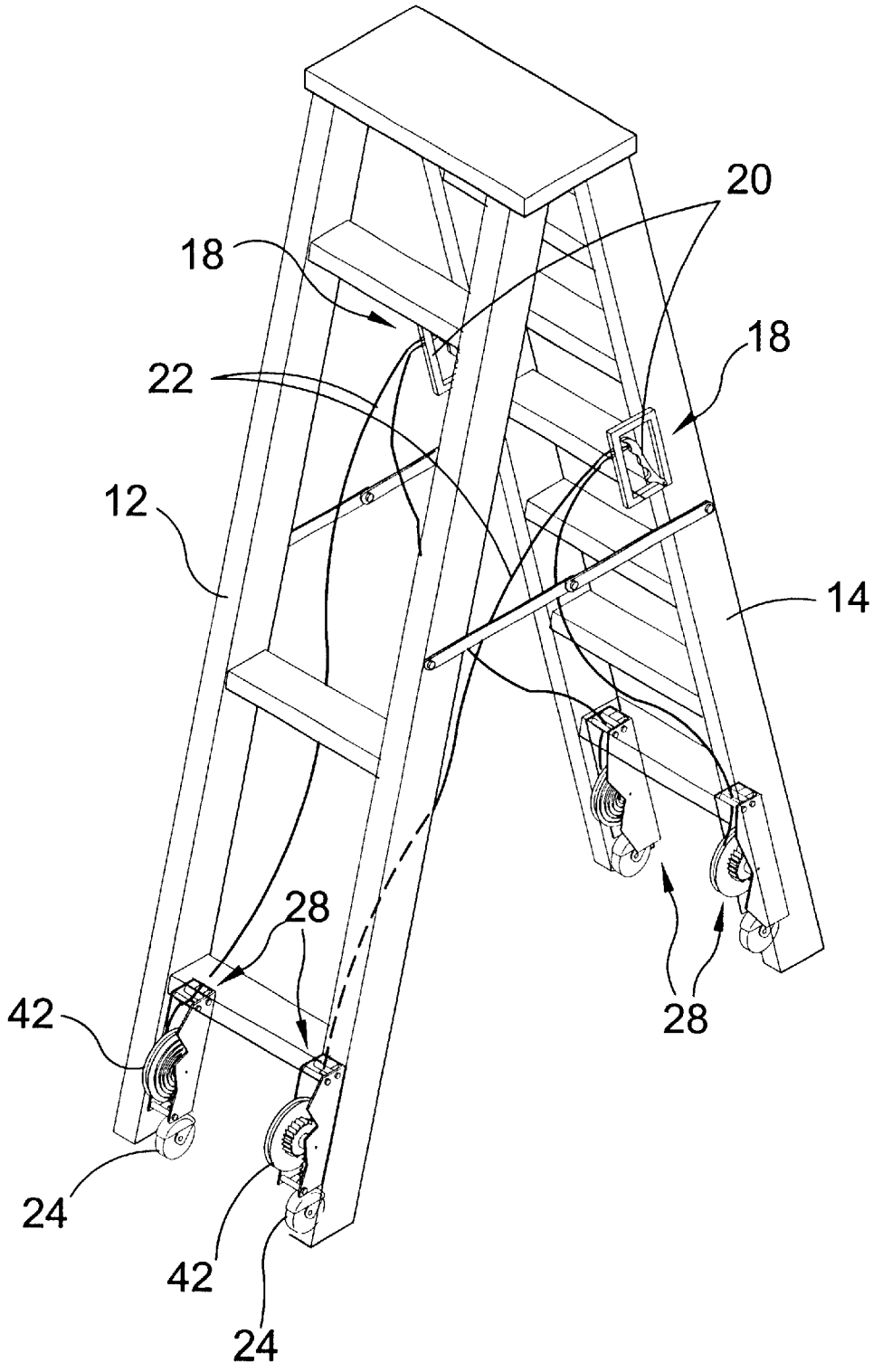
FIG. 3 is a perspective view of the present invention.

FIG. 3 is a perspective view of the present invention 10 integral with an A-frame ladder 12. The wheel extension and lift device for ladders 10 may be manufactured into new ladders 12 or retrofit to existing ladders. The present invention 10 consists of an operator engagement means 18 comprising hand grip trigger mechanisms 20 and related cables 22 that communicate with a rack and pinion gear assembly 28 that includes pulleys 42 and wheel members 24.

Figure 4:
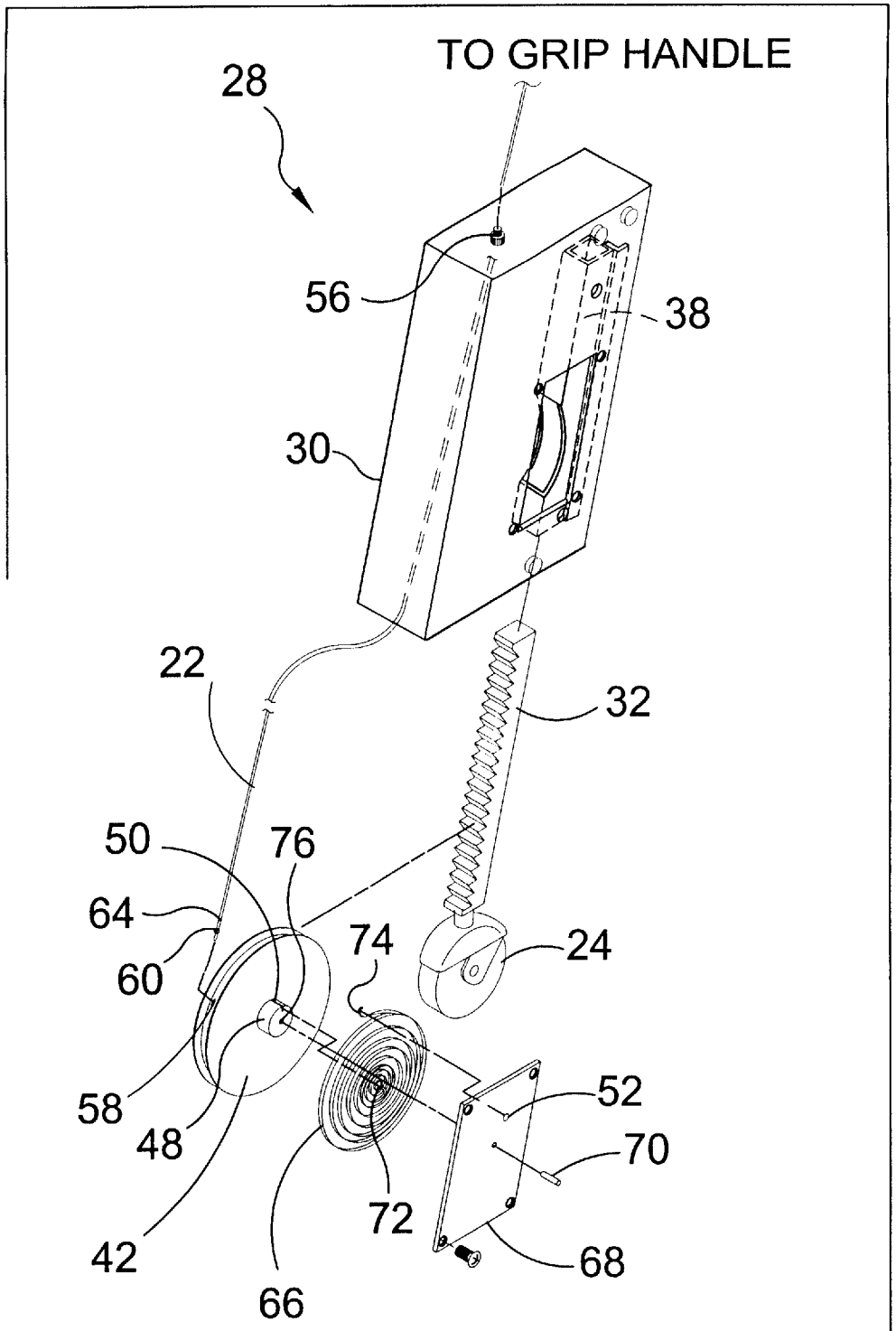
FIG. 4 is an exploded view of the rack guide unit of the present invention.

FIG. 4 is an exploded view of the rack and pinion gear assembly 28 of the present invention 10 showing the rack guide 38 within the gear assembly housing 30 and the cable 22 passing through the cable adjustment means 56 and into the gear assembly housing 30 where the cable stop 60 on the second end 64 of the cable 22 is to be placed within the cable retaining recess 58 of the pulley 42 for engagement therewith. The pulley 42 has a post member 48 extending therefrom with a spring retaining channel 50 traversing therethrough for receiving and retaining the first end 72 of the flat spiral spring element 66. The second end 74 of the spring element 66 is maintained by spring retaining pin 52 that is shown in the removable access cover 68 of the gear assembly housing 30. An axle pin 70 is also shown in the access cover 68 and is to be inserted into the axle recess 76 in the end of the post member 48. The gear rack 32 travels reciprocatively through the rack guide 38 during extension and retraction of the wheel member 24.

Figure 5:
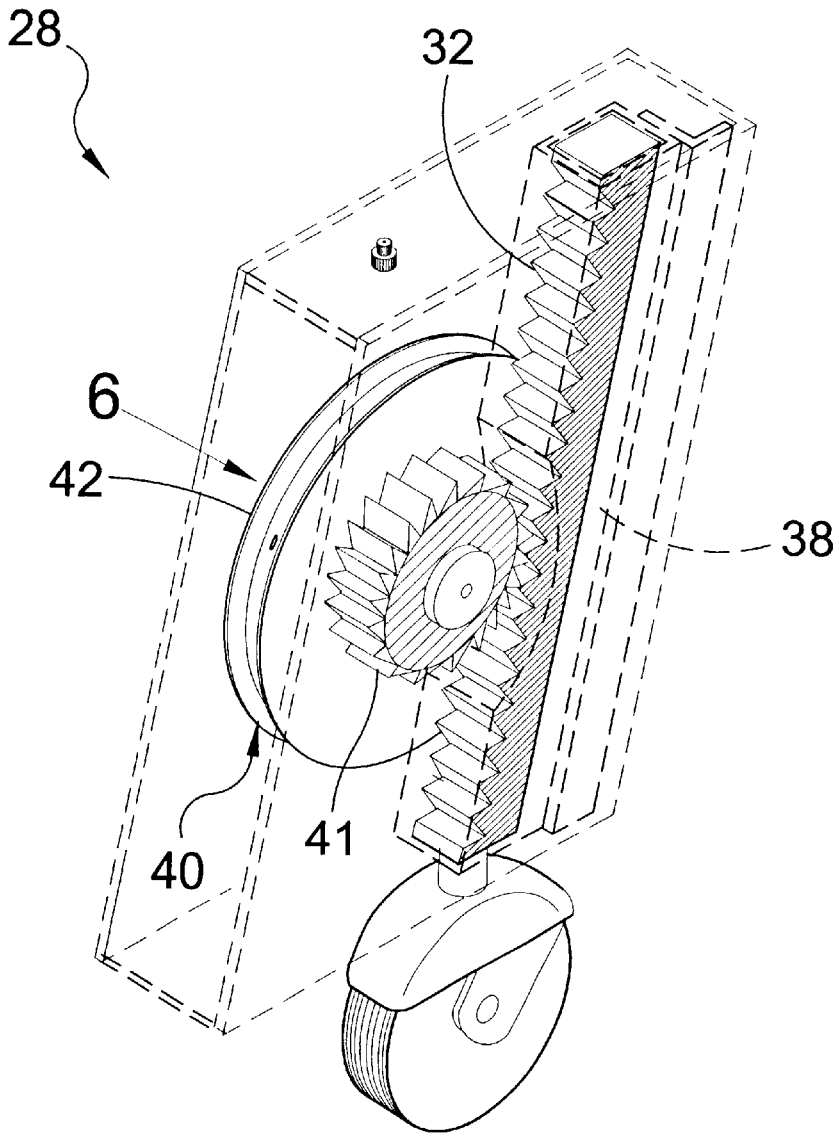
FIG. 5 is a right perspective view of the rack guide unit of the present invention.

FIG. 5 is a detail view of the rack and pinion gear assembly 28 showing the pinion gear 41 engaged with the rack gear 32. The pinion assembly 40 comprises the pinion gear 41 and the attached pulley 42 and the rotation thereof results in the rack gear 32 traveling accordingly through the rack guide 38.

Figure 6:
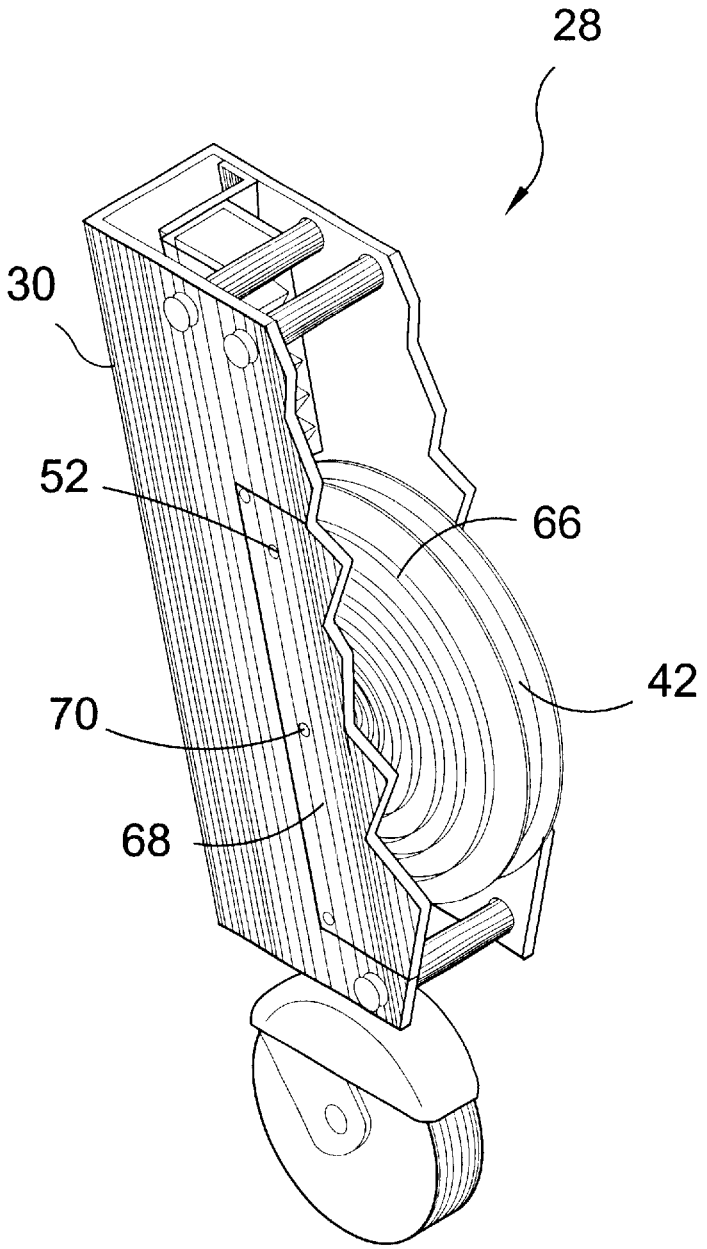
FIG. 6 is a left view of the rack guide unit of the present invention.

FIG. 6 is a detail view of the rack and pinion assembly 28 showing the spring element 66 adjacent the pulley 42 and the spring retaining pin 52 and the axle pin 70 installed in the access cover 68 of the gear assembly housing 30.

Figure 7:
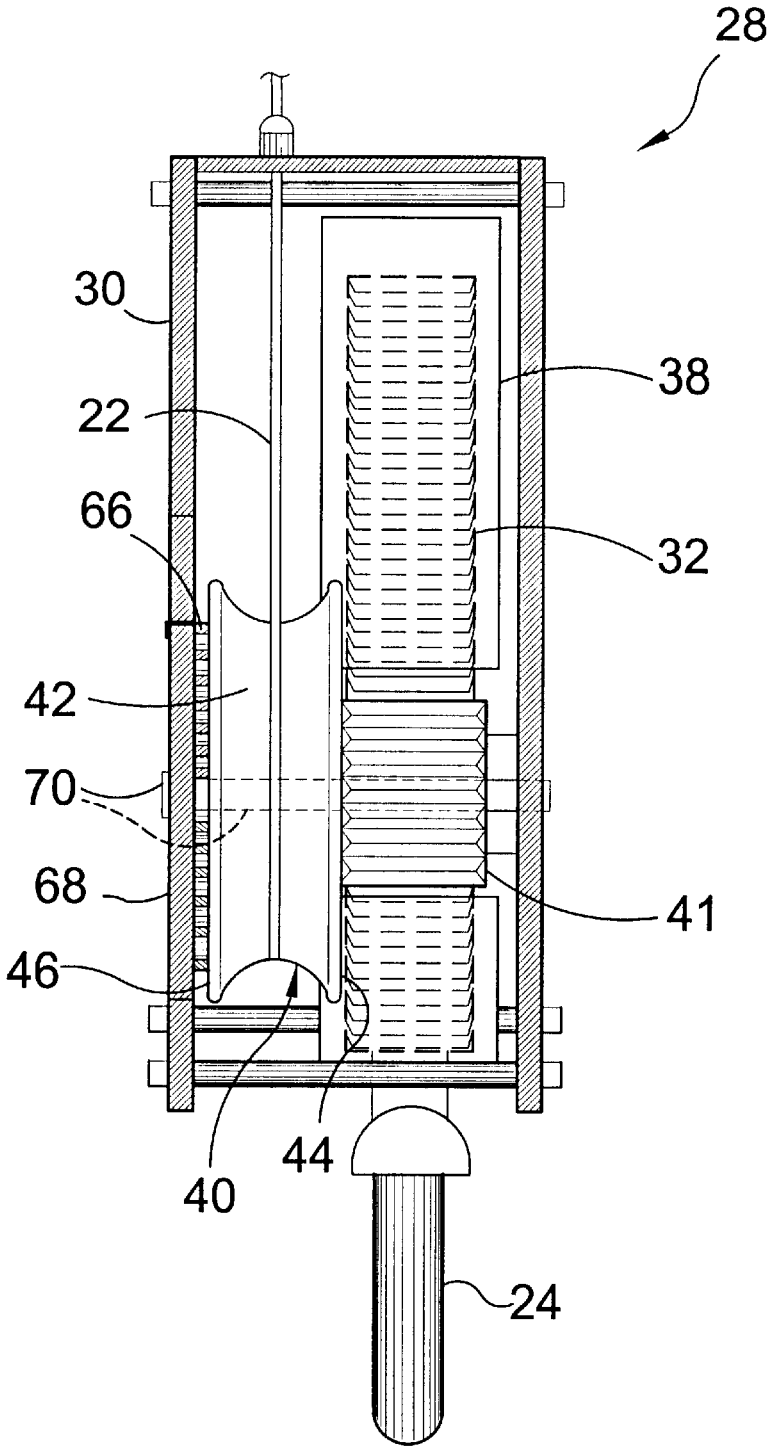
FIG. 7 is a sectional view of the rack guide unit of the present invention.

FIG. 7 is a sectional front view of the rack and pinion gear assembly 28 of the present invention 10. The pinion assembly 40 is axially maintained by the axle pin 70 as it passes centrally through the access cover 68, the spring element 66, the pulley 42, the pinion gear 41, and the gear assembly housing 30. The first side of the pulley 44 is fixedly attached to the pinion gear 41 establishing the pinion assembly 40 which, when rotated by the pulling of the cable 22, drives the gear rack 32 downward until the attached wheel member 24 makes contact with the ground, at which point the applied pressure initiates the lifting of the ladder 12 upward. The rotation of the pinion assembly 40 winds the spring element 66 to create a torque potential until the hand grip trigger mechanism 20 is released and the torque is applied to rotating the pinion assembly 40 in the opposite direction thereby effectively driving the gear rack 32 upward and retracting the wheel member 24 into the stored position where it is maintained by the applied bias of the spring element 66.

Figure 8:
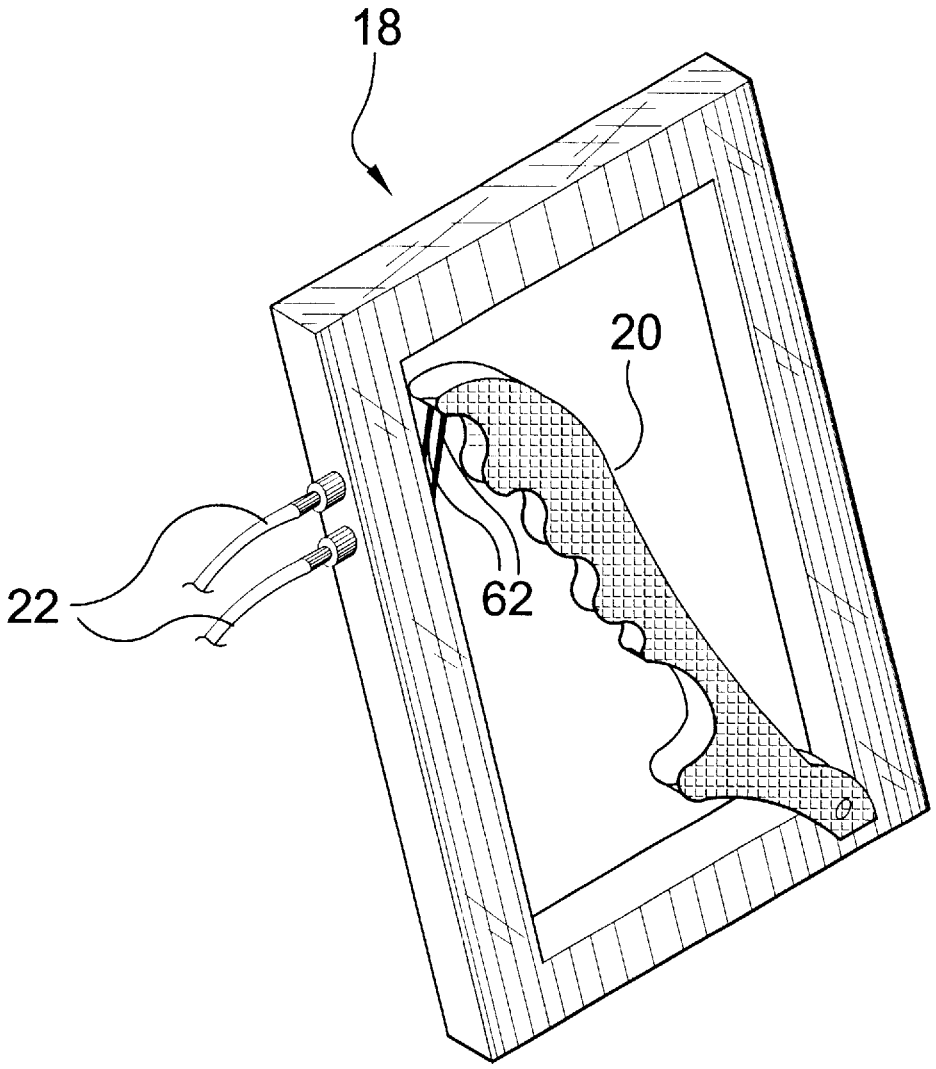
FIG. 8 is a perspective view of the handle grip unit of the present invention.

FIG. 8 is a perspective view of the operator engagement means 18 wherein the first end 62 of the cable 22 is attached to the hand grip trigger mechanism 20 which, when pulled by the operator 54, engages the wheel extension and retraction means 26.

Figure 9:
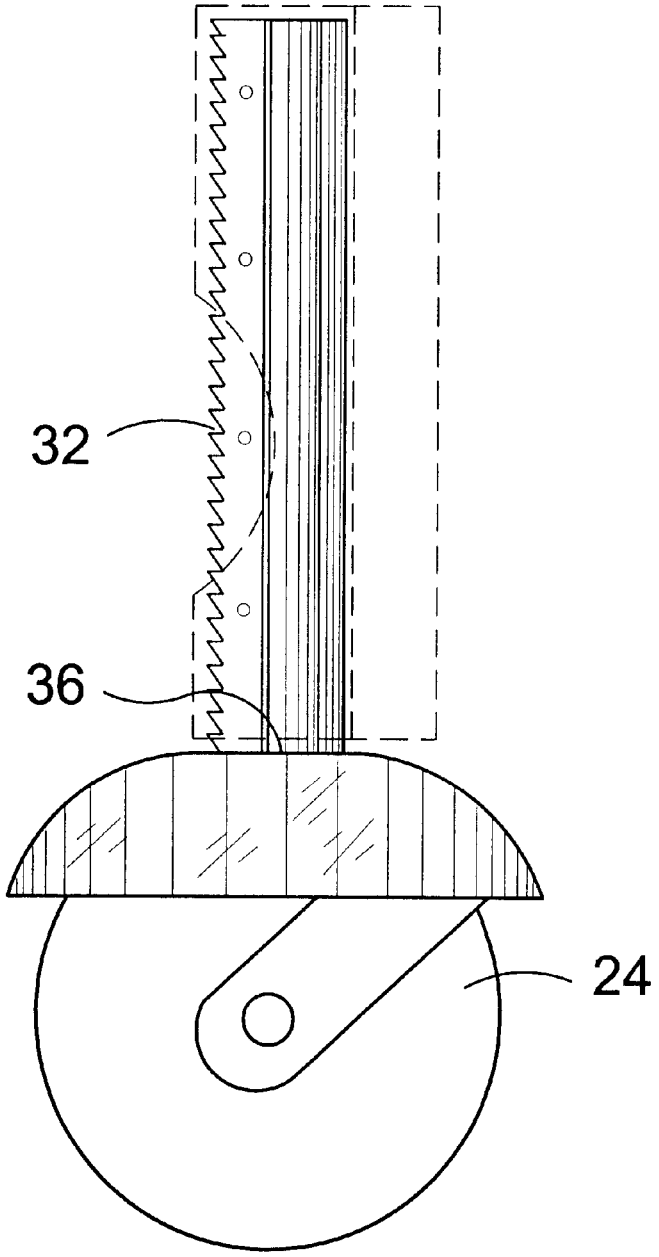
FIG. 9 is a side view of the rack gear with wheel of the present invention.

FIG. 9 is a side view of the rack gear 32 with a pivoting caster type wheel member 24 attached to the bottom 36 thereof. The pivoting action of the wheel member 24 provides for easy maneuverability of the ladder 12 when the rack and pinion gear assembly 28 is engaged.

Figure 10:
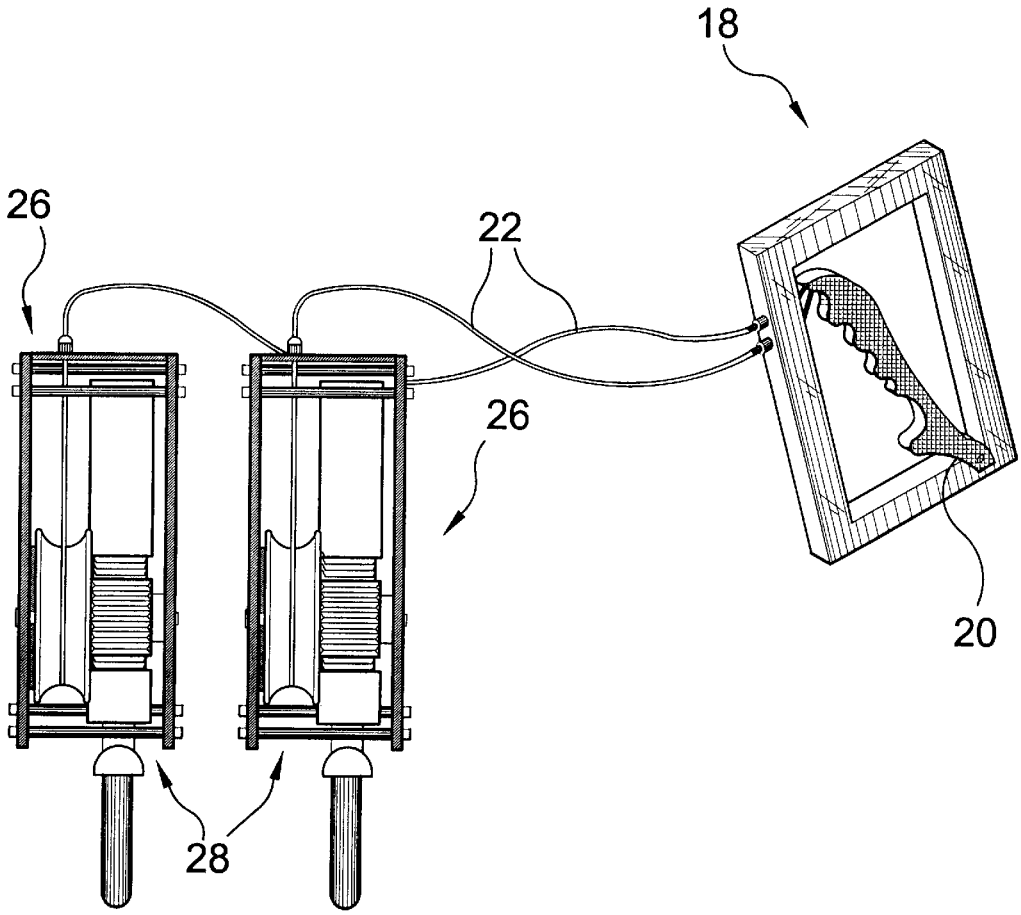
FIG. 10 is a view of the connection between the hand grip and the rack guide assembly of the present invention.

FIG. 10 is a view demonstrating the set-up permitting a single operator engagement means 18 to act upon a plurality of wheel extension and retraction means 26. When the operator 54 pulls the hand grip trigger mechanism 20 the two connected cables 22 simultaneously engage their respective rack and pinion gear assemblies 28.

Figure 11:
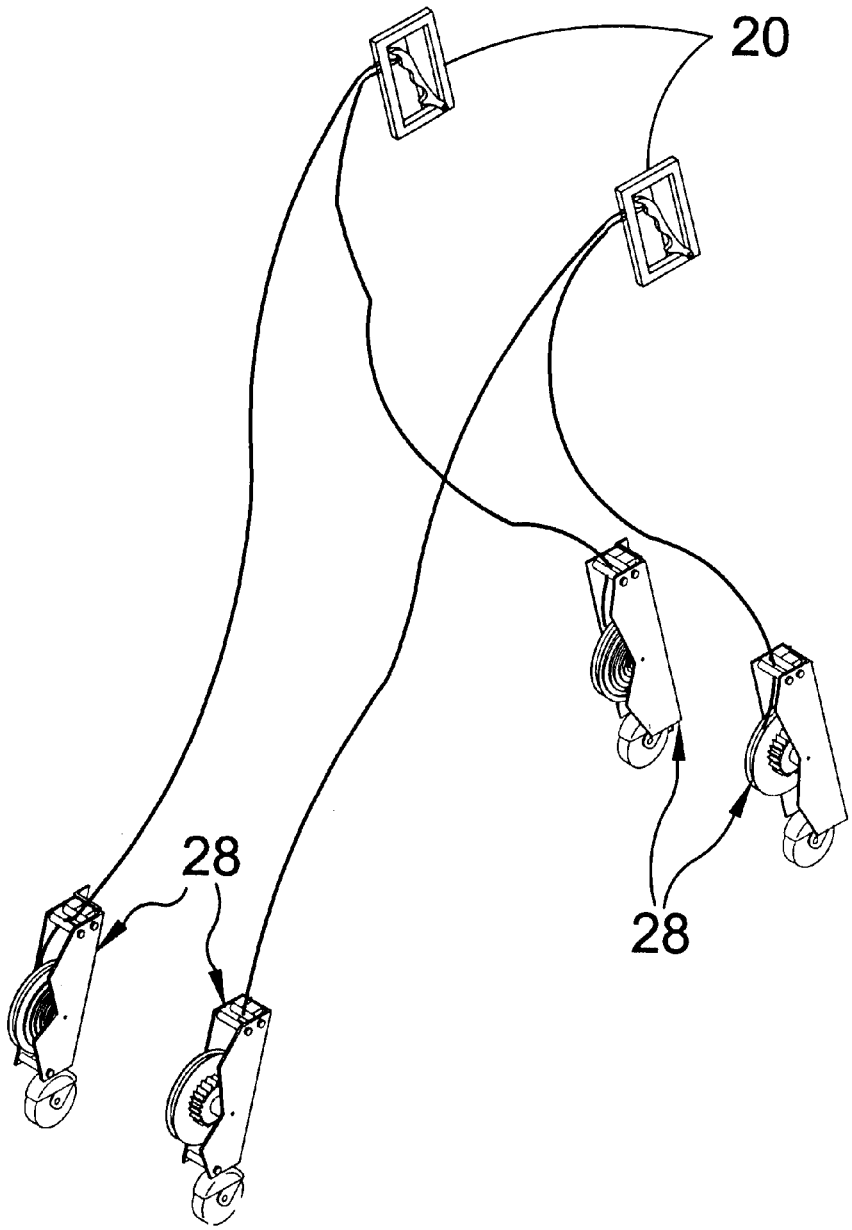
FIG. 11 is a perspective view of the functioning components of the present invention.

FIG. 11 is a perspective view demonstrating the basic configuration of the components of the present invention 10 for it's typical application with an A-frame ladder 12. Two individual hand grip trigger mechanisms 20 each operate two gear assembly housings 30 thereby enabling the operator 54 to simultaneously lift all four legs off of the ground simply by squeezing the two hand grip trigger mechanisms 20 and to set the ladder 12 by releasing them.

Figure 12:
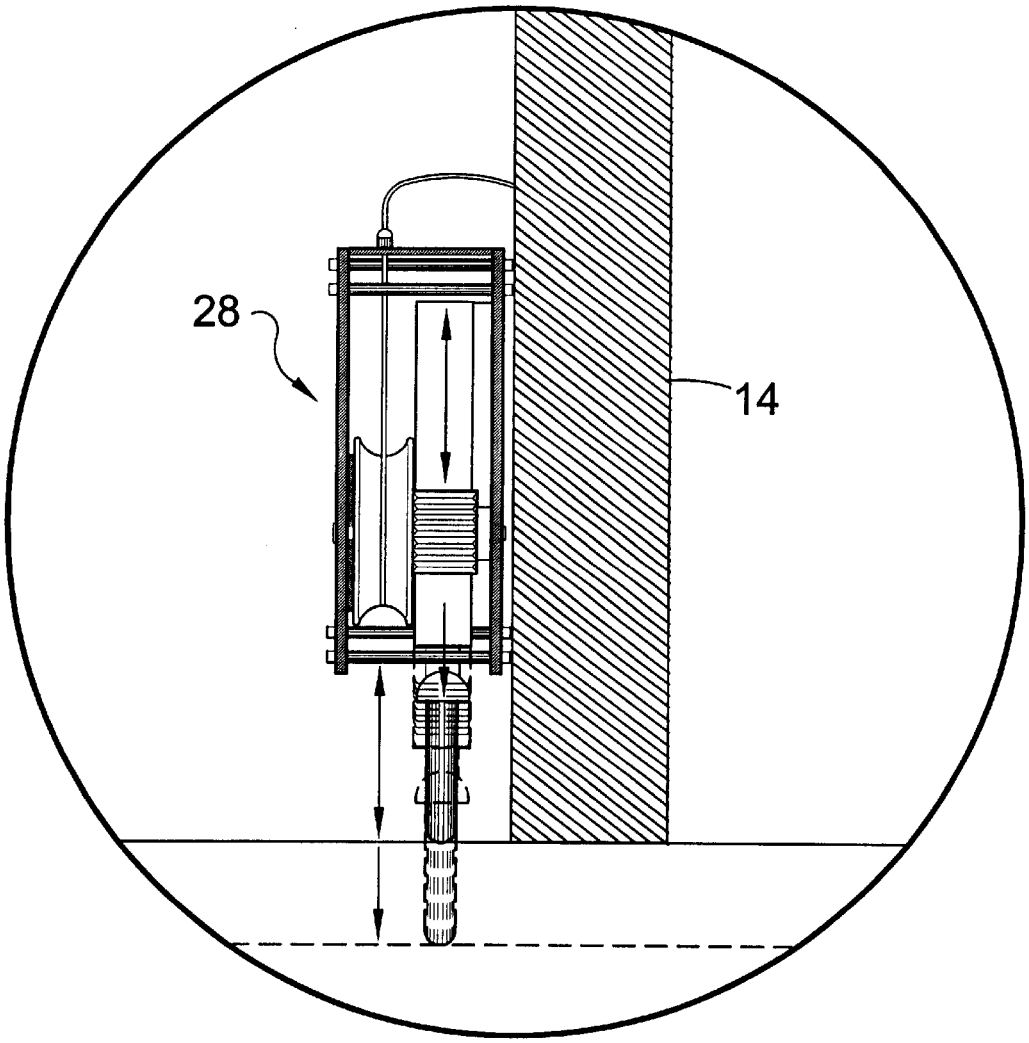
FIG. 12 is a sectional view of the rack guide assembly of the present invention in use.

FIG. 12 is a sectional side view of the rack and pinion gear assembly 28 and ladder sidewall 14 demonstrating the lifting ability of the present invention 10.

It will be understood that each of the elements above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wheel extension and lift device for, and in combination with, a ladder comprising:

a) at least one wheel member positioned at the foot of each ladder siderail;

b) wheel extension means for extending and retracting said wheel members below the feet of the ladder siderails comprising a rack and pinion gear assembly;

c) means for selectively engaging and disengaging said wheel extension means;

d) said rack and pinion gear assembly comprising a gear assembly housing, a substantially vertical rack gear within said housing having a bottom end with said wheel member pivotally attached thereto, a rack guide residing between said rack gear and said housing to stabilize and align the reciprocating movement of said rack as it extends and retracts said wheel member, a pinion assembly with an axle pin extending from either side thereof and connected to said gear assembly housing so as to provide for the axial rotation of said pinion assembly, and said pinion assembly further comprising a pulley having a first side and a second side and a fixedly conjoined pinion gear centrally positioned on said first side of said pulley, said pinion gear interacting with said rack gear in such a manner that the rotation of the pinion gear in response to the rotation of the attached pulley forces the rack gear to extend downward until the wheel attached thereto contacts the ground, at which point the applied force initiates the lifting of the ladder from the ground, the circumference of said pulley being substantially greater than that of said pinion gear.

2. A wheel extension and lift device as recited in claim 1, wherein said means for engaging comprises:

a) at least one handle grip trigger mechanism mounted on a siderail and situated in a position that is easily accessible by a user; and b) a cable communicating between said handle grip trigger mechanism and said wheel extension and retraction means.

3. A wheel extension and lift device as recited in claim 2, wherein the user pulls the handle grip trigger mechanism and the attached cable engages the wheel extension and retraction means so as to extend the wheel members below the bottom of the ladder siderails thereby effectively raising the ladder with the entire weight thereof applied to the wheel members to permit the user to roll the ladder into a different position until such time that the handles are released thus allowing the wheel members to retract back to the stored position.

4. A wheel extension and lift device as recited in claim 3, wherein said extension and retraction means uses gravity and the weight of the ladder to retract said wheels when the user releases said hand grip trigger mechanism.

5. A wheel extension and lift device as recited in claim 1, wherein said extension and retraction means further includes a spring element to place an upwards bias to said wheel members to maintain them in the stored position when not in use and to retract them when said handle grip trigger mechanism is released.

6. A wheel extension and lift device as recited in claim 1, wherein said pinion assembly further includes a spiral spring element having a central first end in communication with said pulley and a peripheral second end engaged with said gear assembly housing, each said end conformed to engage with it's respective element.

7. A wheel extension and lift device as recited in claim 6, wherein said gear assembly housing includes a spring retaining pin for engaging and restricting movement of the said second end of said spiral spring element.

8. A wheel extension and lift device as recited in claim 6, wherein said spring element is wound tighter during the axial rotation of said pulley as initiated by the operator thereby creating a tension that is released accordingly as the pressure applied to said hand grip trigger mechanism is released thus resulting in the retraction of said gear rack and said wheel element until in the stored position where they remain due to the bias applied thereto by the remaining tension of said spring element.

9. A wheel extension and lift device as recited in claims 1, wherein said pinion assembly further includes:

a) a circular post member extending from the central portion of said second side of said pulley; and b) a spring retaining channel traversing said post member to receive said first end of said spring element.

10. A wheel extension and lift device as recited in claim 1, wherein said pulley is of a significantly larger circumference than said pinion gear thereby creating a favorable differential thereof and allowing for a minimal amount of pressure applied by the user to lift a greater amount of weight.

11. An improved ladder apparatus of the type having a plurality of parallel rungs with the distal ends thereof engaging with siderails to allow a user to climb or stand at any of a plurality of predetermined heights above ground level, wherein the improvement comprises:

a) at least one wheel positioned immediately above the bottom of each siderail; and b) user control means for allowing a user to selectively control the extension and retraction of said wheel beyond the bottom of each siderail thereby mechanically lifting the ladder from the ground in a controlled manner so that it may be rolled into a different position as determined by the user;

c) said user control means comprises means for extending and retracting said wheel members below the feet of the ladder siderails and wheel extension means for allowing an operator to selectively engage and disengage said wheel extension and retraction means;

d) said user control means comprising at least one handle grip trigger mechanism mounted on a siderail and situated in a position that is easily accessible by the user and a cable communicating between said handle grip trigger mechanism and at least one said wheel extension means; and e) said wheel extension and retraction means comprising a gear assembly housing, a substantially vertical rack gear having a bottom end within said housing with said wheel member attached to said bottom end, a rack guide residing between said rack gear and said housing to stabilize and align the reciprocating movement of said rack as it extends and retracts said wheel member, a pinion assembly with an axle pin extending from either side thereof and connected to said gear assembly housing so as to provide for the axial rotation of said pinion assembly, and said pinion assembly further comprising a pulley having a first side and a second side and a fixedly conjoined pinion gear centrally positioned on said first side of said pulley, said pinion gear interacting with said rack gear in such a manner that the rotation of the pinion gear in response to the rotation of the attached pulley forces the rack gear to extend downward until the wheel attached thereto contacts the ground, at which point the applied force initiates the lifting of the ladder from the ground, the circumference of said pulley being substantially greater than that of said pinion gear.

12. An improved ladder apparatus of the type having a plurality of parallel rungs with the distal ends thereof engaging with siderails to allow a user to climb or stand at any of a plurality of predetermined heights above ground level as recited in claim 11, wherein said wheel extension and retraction means further comprises a spring element to place an upwards bias to said wheel members to maintain them in the stored position when not in use and to retract them when said handle grip trigger mechanism is released.

13. An improved ladder apparatus of the type having a plurality of parallel rungs with the distal ends thereof engaging with siderails to allow a user to climb or stand at any of a plurality of predetermined heights above ground level as recited in claim 12, wherein said spring element is substantially spiral having a central first end in communication with said pulley and a peripheral second end engaged with said gear assembly housing, each said end conformed to engage with it's respective element.

14. An improved ladder apparatus of the type having a plurality of parallel rungs with the distal ends thereof engaging with siderails to allow a user to climb or stand at any of a plurality of predetermined heights above ground level as recited in claim 11, wherein said pinion assembly further includes:

a) a circular post member extending from the central portion of said second side of said pulley; and b) a spring retaining channel traversing said post member to receive said first end of said spring element.

15. An improved ladder apparatus of the type having a plurality of parallel rungs with the distal ends thereof engaging with siderails to allow a user to climb or stand at any of a plurality of predetermined heights above ground level as recited in claim 11, wherein said gear assembly housing further includes a spring retaining pin for engaging and restricting movement of the said second end of said spiral spring element.

16. An improved ladder apparatus of the type having a plurality of parallel rungs with the distal ends thereof engaging with siderails to allow a user to climb or stand at any of a plurality of predetermined heights above ground level as recited in claim 11, wherein said spring element is wound tighter during the axial rotation of said pulley as initiated by the operator thereby creating a tension that is released accordingly as the pressure applied to said hand grip trigger mechanism is released thus resulting in the retraction of said gear rack and said wheel element until in the stored position where they remain due to the bias applied thereto by the remaining tension of said spring element.

17. An improved ladder apparatus of the type having a plurality of parallel rungs with the distal ends thereof engaging with siderails to allow a user to climb or stand at any of a plurality of predetermined heights above ground level as recited in claim 11, wherein said pulley is of a significantly larger circumference than said pinion gear thereby creating a favorable differential thereof and allowing for a minimal amount of pressure applied by the user to lift a greater amount of weight.

* * * * *